US007935409B2

(12) United States Patent
Burazin et al.

(10) Patent No.: US 7,935,409 B2
(45) Date of Patent: May 3, 2011

(54) TISSUE SHEETS HAVING IMPROVED PROPERTIES

(75) Inventors: Mark Alan Burazin, Oshkosh, WI (US); Edward Joseph VanRengen, Appleton, WI (US); Kenneth Curtis Larson, Appleton, WI (US); Jerome Steven Veith, Menasha, WI (US); Ralph Lee Anderson, Marietta, GA (US); Michael William Veith, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 761 days.

(21) Appl. No.: 11/274,106

(22) Filed: Nov. 14, 2005

(65) Prior Publication Data

US 2006/0083899 A1 Apr. 20, 2006

Related U.S. Application Data

(63) Continuation of application No. 09/441,987, filed on Nov. 17, 1999, now abandoned, which is a continuation-in-part of application No. 09/129,814, filed on Aug. 6, 1998, now abandoned.

(51) Int. Cl.
*B32B 1/00* (2006.01)

(52) U.S. Cl. ..... 428/174; 162/109

(58) Field of Classification Search ..... 428/174, 428/179, 180; 162/109, 112, 113, 117
See application file for complete search history.

(56) References Cited

U.S. PATENT DOCUMENTS

| | | | | |
|---|---|---|---|---|
| 1,624,049 | A | | 4/1927 | Kurtz-Hahnle et al. |
| 3,478,991 | A | | 11/1969 | Schiel et al. |
| 3,817,827 | A | * | 6/1974 | Benz ..... 162/113 |
| 3,905,863 | A | * | 9/1975 | Ayers ..... 162/113 |
| 4,426,795 | A | | 1/1984 | Rudt |
| 4,671,983 | A | | 6/1987 | Burt |
| 4,972,561 | A | | 11/1990 | Aldrich |
| 5,219,004 | A | | 6/1993 | Chiu |
| 5,356,364 | A | | 10/1994 | Veith et al. |
| 5,597,639 | A | * | 1/1997 | Schulz ..... 428/156 |
| 5,628,876 | A | | 5/1997 | Ayers et al. |
| 5,656,132 | A | | 8/1997 | Farrington, Jr. et al. |
| 5,672,248 | A | | 9/1997 | Wendt et al. |
| 5,693,403 | A | | 12/1997 | Brown et al. |
| 5,702,571 | A | * | 12/1997 | Kamps et al. ..... 162/117 |
| 5,746,887 | A | | 5/1998 | Wendt et al. |
| 6,017,417 | A | | 1/2000 | Wendt et al. |
| 6,077,590 | A | | 6/2000 | Archer et al. |

FOREIGN PATENT DOCUMENTS

| | | |
|---|---|---|
| EP | 0 566 775 A1 | 10/1993 |
| GB | 2 288 594 A | 10/1995 |

* cited by examiner

*Primary Examiner* — Alicia Chevalier
(74) *Attorney, Agent, or Firm* — Michael J. Sullivan; Gregory E. Croft

(57) ABSTRACT

The roll properties of tissue sheets are improved either by imparting cross-machine direction dominant bar-like protrusions to the air side of the tissue by using specially woven transfer fabrics and/or by offsetting recurring surface features of the sheet relative to the surface features of adjacent sheets within the roll, such as by providing a throughdryer fabric with an offset seam. Both techniques provide the resulting tissue sheets with improved capabilities for providing an improved combination of roll bulk and roll firmness.

8 Claims, 15 Drawing Sheets

TISSUE SHEETS HAVING IMPROVED PROPERTIES

This application is a continuation application of U.S. Ser. No. 09/441,987 filed Nov. 17, 1999 which is a continuation-in-part application of U.S. Ser. No. 09/129,814 filed Aug. 6, 1998.

BACKGROUND OF THE INVENTION

Throughdried tissues have recently been developed which provide a unique combination of bulk and softness. In part, a method for making such tissues includes the use of a through-drying fabric having high and long machine direction knuckles which impart a high degree of texture to the resulting tissue sheet. When such sheets are used for making bath tissue or paper toweling, they are wound into a roll for sale to the consumer. However, in spite of the high bulk and texture of the resulting tissue sheet, when wound into a roll the sheet has a tendency to "nest" as the protrusions of the sheet mate with corresponding depressions of the adjacent sheet in the wound roll. As a result, the wound roll has good firmness, but does not exhibit exceptional roll bulk befitting of the high texture exhibited by the sheet itself.

Therefore there is a need for a method of imparting good firmness and high bulk to rolls of tissue sheets having high bulk and texture.

SUMMARY OF THE INVENTION

It has now been discovered that the bulk/firmness properties of rolls of tissue sheets, including throughdried tissue sheets, can be improved by modifying the fabrics used in the process of manufacturing the tissue sheet. The resulting rolls have both a high degree of bulk and firmness, particularly for rolls made from relatively soft sheets.

Hence in one aspect, the invention resides in a method of making a throughdried tissue sheet comprising (a) depositing an aqueous suspension of papermaking fibers onto a forming fabric to form a wet web; (b) dewatering the wet web to a consistency from about 20 to about 30 percent; (c) transferring the dewatered web from the forming fabric to the sheet side of a transfer fabric traveling at a speed from about 10 to about 80 percent slower than the forming fabric; (d) transferring the web to a throughdrying fabric having from about 5 to about 300 impression knuckles per square inch which are raised at least about 0.005 inch above the plane of the fabric, wherein the web is macroscopically rearranged to conform to the surface of the throughdrying fabric; and (e) throughdrying the web, wherein the sheet side of the transfer fabric contains cross-machine direction (CD) dominant troughs which impart cross-machine direction dominant bar-like protrusions to the air side of the tissue sheet.

As used herein, the "dryer side" of the tissue sheet is the side of the sheet facing the throughdrying fabric during throughdrying and the "air side" of the sheet is the side of the sheet facing away from the throughdrying fabric during throughdrying. When the sheet is wound into a roll of product, it is often preferred that the air side of the sheet be the side of the sheet facing the core of the roll and the dryer side of the sheet be the outwardly facing side of the sheet.

Also as used herein, the term "cross-machine direction dominant" means that the bar-like protrusions or troughs run at an angle of about 44° or less, more specifically about 20° or less, and still more specifically about 10° or less, relative to the cross-machine direction of the sheet or fabric. The bar-like protrusions can be parallel with the cross-machine direction of the sheet. Similarly, the term "machine direction dominant" means that the feature in question runs at an angle of about 44° or less, more specifically about 20° or less, and still more specifically about 10° or less, relative to the machine direction of the sheet or fabric. The machine direction dominant feature in question can also be parallel or substantially parallel to the machine direction of the sheet or fabric.

The bar-like protrusions can extend continuously across the width of the sheet but, due to some slippage of the woven fabric filaments, in practice the bar-like protrusions within a given sheet randomly vary in length. Accordingly, the length of the bar-like protrusions can be about 3 millimeters or greater, more specifically from about 3 millimeters to about 300 millimeters, more specifically from about 5 millimeters to about 50 millimeters, and still more specifically from about 5 millimeters to about 25 millimeters, including combinations of the foregoing ranges. The width of the bar-like protrusions corresponds to the spacing between the CD dominant filaments of the transfer fabric and can be about 0.3 millimeter or greater, more specifically from about 0.3 to about 3 millimeters, still more specifically from about 0.5 to about 1.5 millimeters. In addition, single CD dominant filaments within the transfer fabric can be replaced with multiple CD dominant filaments piled atop each other to form deeper CD dominant troughs within the fabric and therefore form higher bar-like protrusions in the air side of the sheet.

In another aspect, the invention resides in a tissue sheet having an air side and a dryer side, the dryer side of the sheet having parallel discontinuous rows of machine direction dominant pillow-like elevated regions, which can be imparted to the sheet by the spaces between high and long machine direction dominant knuckles in the throughdryer fabric, wherein the discontinuities in the rows of pillow-like elevated regions are cross-machine direction dominant troughs that appear as cross-machine direction dominant bar-like protrusions on the air side of the sheet. The discontinuities in the rows of pillow-like elevated regions substantially suppress the tendency of the rows of pillow-like elevated regions in the sheet from nesting when the sheet is wound into a roll.

In another aspect, the invention resides in a method of making a throughdried tissue sheet comprising (a) depositing an aqueous suspension of papermaking fibers having a consistency of about 1 percent or less onto a forming fabric to form a wet web; (b) dewatering the wet web to a consistency from about 20 to about 30 percent; (c) transferring the dewatered web from the forming fabric to a transfer fabric traveling at a speed from about 10 to about 80 percent slower than the forming fabric; (d) transferring the web to a throughdrying fabric having from about 5 to about 300 impression knuckles per square inch which are raised at least about 0.005 inch above the plane of the fabric, wherein the web is macroscopically rearranged to conform to the surface of the throughdrying fabric; and (e) throughdrying the web, wherein the throughdrying fabric has an offset seam which results in the machine direction yarns of the throughdrying fabric being disposed at an angle of about 2° or less, more specifically about 1° or less, still more specifically from about 0.05° to about 1°, and still more specifically from about 0.1° to about 0.6° relative to the machine direction of the fabric. As used herein, the term "offset" means that the seam is formed after the edges of the fabric have been displaced in the cross-machine direction beyond that which may occur inadvertently during normal seaming operations. The concept of an offset seam will be more fully described in the description of FIG. 11.

In another aspect, the invention resides in a tissue sheet comprising generally parallel rows of elevated pillow-like regions running at an acute angle relative to the machine direction of the sheet. The angle can be from about 0.05° to about 2°, more specifically from about 0.05° to about 1°, and still more specifically from about 0.1° to about 0.6°. The angle results from an offset seam in the throughdrying fabric and substantially suppresses the tendency of the sheet to nest when wound into rolls. A similar result can be achieved with a conventionally seamed fabric, but by oscillating the roll upon which the web is being wound at an amplitude and frequency which suppresses the tendency of the features of the web to line up and nest and increases the roll bulk/roll firmness ratio relative to a roll of the same sheet material wound without oscillating the roll.

In another aspect, the invention resides in a roll of tissue having a roll bulk of 16 cubic centimeters or greater per gram and a roll firmness of 8 millimeters or less.

In another aspect, the invention resides in a roll of tissue having a roll bulk/roll firmness ratio of 20 or more square centimeters per gram and a sheet caliper from about 0.02 to about 0.05 inch.

In another aspect, the invention resides in a roll of tissue having a roll bulk/roll firmness ratio of 20 or more square centimeters per gram and a geometric mean stiffness of about 8 or less.

In another aspect, the invention resides in a roll of tissue having a roll bulk/roll firmness/single sheet caliper ratio of about 350 or more centimeters per gram and a geometric mean stiffness of about 8 or less.

The roll bulk for rolls of tissue made in accordance with this invention can be 16 cubic centimeters or greater per gram of fiber, more specifically about 17 cubic centimeters or greater per gram of fiber, and still more specifically from about 17 to about 20 cubic centimeters per gram.

The roll firmness of rolls of tissue made in accordance with this invention can be about 11 millimeters or less, more specifically about 8 millimeters dr less, more specifically about 7 millimeters or less, more specifically about 6 millimeters or less, and still more specifically from about 4 to about 7 millimeters.

The roll bulk/roll firmness ratio of rolls of tissue made in accordance with this invention can be 20 or more square centimeters per gram, more specifically about 25 or more square centimeters per gram, and still more specifically from about 25 to about 55 square centimeters per gram.

The single sheet caliper of the tissue sheets useful for purposes of this invention can be from about 0.02 to about 0.05 inch (0.51 to about 1.27 millimeters), more specifically from about 0.025 to about 0.045 inch (0.64 to about 1.14 millimeters).

The geometric mean stiffness of the tissue sheets useful for purposes of this invention can be about 8 or less, more specifically about 5 or less, and still more specifically from about 2 to about 5.

The roll bulk/roll firmness/single sheet caliper ratio of rolls of tissue in accordance with this invention can be about 350 or more centimeters per gram, more specifically about 390 or more centimeters per gram, more specifically about 430 or more centimeters per gram, and still more specifically from about 350 to about 550 centimeters per gram.

In addition to the above-mentioned properties which directly relate to or impact the properties of a wound roll of product, the absorbent capacity of the sheets useful for purposes of this invention can be about 5 or more grams of water per gram of fiber, more specifically from about 5 to about 8 grams of water per gram of fiber, and still more specifically from about 5.5 to about 7 grams of water per gram of fiber.

Also, the absorbent rate of sheets useful for purposes of this invention can be about 4 seconds or less, more specifically from about 1 to about 4 seconds, and still more specifically from about 2 to about 3 seconds.

The Horizontal Wicking rate for sheets in accordance with this invention can be 2.0 or greater, more specifically about 2.3 or greater, more specifically about 2.5 or greater, more specifically about 2.8 or greater, more specifically from 2.0 to 3, and still more specifically from about 2.2 to about 2.8. Horizontal Wicking rate values are expressed as centimeters per the square root of seconds as described below.

The Wipe Dry area, expressed in square centimeters as described below, for sheets in accordance with the invention can be from about 650 to 1000, more specifically from about 700 to 1000, more specifically from about 800 to 1000, and still more specifically from about 900 to 1000 square centimeters.

The unique absorbent properties of the sheets of this invention are at least in part due to the "ridges" in the sheet that interact with the surface to be wiped to form wicking channels. These channels have a cross-sectional area of about 500,000 square microns or less and can be straight or non-straight.

As used herein, "roll bulk" is the bulk of the wound product, excluding the core volume, and is most easily understood with reference to FIG. 2. FIG. 2 illustrates a typical roll product having a core, around which the paper product is wound. The radius of the roll product is designated as "R", whereas the radius of the core is designated as "r". The width or length of the roll is designated as "L". All measurements are expressed as "centimeters". The product roll volume "RV", expressed in cubic centimeters (cc), is the volume of the product minus the volume of the core, namely $RV=(\pi R^2L)-(\pi r^2L)$. The product roll weight "W" is the weight of the roll minus the weight of the core, measured in grams (g). Alternatively, the roll weight "W" can be calculated by multiplying the basis weight of the sheet, expressed in grams per square meter, by the area of the sheet (length times width), expressed in square meters. Either way, the "roll bulk", expressed in cubic centimeters per gram (cc/g), is "RV" divided by "W".

As used herein, "roll firmness" is a measure of the extent a probe can penetrate the roll under controlled conditions and is readily understood with reference to FIG. 3, which illustrates the apparatus used for determining roll firmness. The apparatus is available from Kershaw Instrumentation, Inc., Swedesboro, N.J. and is known as a Model RDT-101 Roll Density Tester. Shown in FIG. 3 is a towel roll 80 being measured, which is supported on a spindle 81. When the test begins a traverse table 82 begins to move toward the roll. Mounted to the traverse table is a sensing probe 83. The motion of the traverse table causes the sensing probe to make contact with the towel roll. When the sensing probe contacts the roll, the force exerted on the load cell exceeds the low set point of 6 grams and the displacement display is zeroed and begins indicating the penetration of the probe. When the force exerted on the sensing probe exceeds the high set point of 687 grams, the traverse table stops and the displacement display indicates the penetration in millimeters. The tester records this reading. Next the tester rotates the towel roll 90° on the spindle and repeats the test. The roll firmness value is the average of the two readings, expressed in millimeters. The test is performed in a controlled environment of 73.4±1.8° F. and 50±2% relative humidity. The rolls are conditioned in this environment at least 4 hours before testing.

As used herein, "geometric mean stiffness" is the geometric mean slope divided by the geometric mean tensile strength; where the geometric mean tensile strength is the square root of the product of the machine direction tensile strength and the cross-machine direction tensile strength, expressed in grams per 3 inches (7.62 cm); and where the geometric mean slope is the square root of the product of the machine direction slope and the cross machine direction slope, expressed in grams per 3 inches (7.62 cm); and where machine direction slope and cross machine direction slope are as described in U.S. Pat. No. 5,746,887 issued May 5, 1998 to Wendt et al. entitled Method of Making Soft Tissue Products, which is hereby incorporated by reference.

As used herein, the "single sheet caliper" is measured in accordance with TAPPI test method T402 "Standard Conditioning and Testing Atmosphere For Paper, Board, Pulp Handsheets and Related Products" and is measured as one sheet using an EMVECO 200-A Microgage automated micrometer (EMVECO, Inc., Oregon). The micrometer has an anvil diameter of 2.22 inches (56.4 millimeters) and an anvil pressure of 132 grams per square inch (per 6.45 square centimeters) (2.0 kPa).

As used herein, the "absorbent capacity" of tissue sheets is determined by cutting the tissue sheets into 4 inches by 4 inches squares, placing twenty squares into a stack such that all squares are oriented the same relative to the machine direction of the tissue, and stapling the corners of the stack together to form a 20 sheet pad. The pad is placed into a wire mesh basket with the staple points down and lowered into a water bath held at a temperature of 23° C.±2° C. When the pad is completely wetted, it is removed and allowed to drain for 30 seconds while in the wire basket. The weight of the water remaining in the pad after 30 seconds is the amount absorbed. This value is divided by the weight of the pad to determine the absorbent capacity, which for purposes herein is expressed as grams of water absorbed per gram of fiber.

As used herein, the "absorbent rate" of tissue sheets is determined by same procedure as for the absorbent capacity, except the size of the pad is 2.5 inches by 2.5 inches. The time taken for the pad to completely wet out after being lowered into the water bath is the absorbent rate, expressed in seconds. Higher numbers mean that the rate at which water is absorbed is slower.

As used herein, the "Horizontal Wicking" test measures the rate of liquid transport through a material placed on a flat surface. The test is a useful research tool for screening materials. Essentially the test measures the location of liquid wetting front in the material as a function of time. The wetting front images are captured and analyzed digitally.

The Horizontal Wicking setup is illustrated in FIG. 13. The reservoir maintains its liquid level through a vented flask. Next to the reservoir sits a horizontal platform in line with reservoir liquid level. The sample absorbent material is placed on the platform with one end in contact with the reservoir liquid. Mounted above the platform is a black and white digital camera, which records and transfers images to a PC via a frame grabber. A custom program, which uses image analysis software, captures images at previously specified time intervals and determines the distance the fluid wetting front wicks as a function of time. Data are plotted as distance versus square root of time. The rate of liquid absorption is reported as a slope which is obtained by using least squares linear regression technique.

Test Setup and Procedure:

The vented flask is filled with liquid of interest. The lower end of the vent in the flask is kept at the reservoir liquid level. The stopcock, between the vented flask and the reservoir, is kept closed while filling the flask or draining the reservoir. The reservoir has two valves at the base, one connecting it to the flask and the other used to drain it. The platform for placing samples is a stainless steel plate 14" long and 3.5" wide. The platform, the reservoir, and the camera are all fixed into a lighted chamber.

Before testing the imaging software is configured. This is required to establish material brightness and to determine gray scale differentiation for optimal detection of the liquid wetting front. After completing the software configuration the actual test can begin.

The test is conducted on single-layered porous materials only. It is not conducted on multilayered materials or SAP containing composites. The platform size limits the sample width to be less than 3.5 inches. A good samples size is close to 10"×1.5". For materials in which the pores have an orientation, samples should be cut with length in the direction of wicking in the actual product. To reduce the effect of densification on the edges of the sample a textile saw is recommended for cutting. After cutting, the sample weight and bulk are recorded. For materials sensitive to temperature and humidity, conditioning and testing is carried out at 23±1□C (73.4±1.8□F) and 50±2% relative humidity.

In the beginning the liquid in the reservoir is drained to a level of 0.25" inches below it's crest. Then the sample is laid onto the platform with 0.5" inches extending into the reservoir. At the same time the imaging program is initiated to capture five images per second until liquid is detected in the sample. The experiment is initiated by opening the stopcock between the vented flask and the reservoir; this allows the reservoir to fill to its crest and come in contact with the sample. Once liquid is detected in the sample the software begins capturing the images at equal intervals and calculates distance of wetting front from the origin. After the desired number of data points have been captured, the sample is removed from the platform, and the stopcock between the flask and reservoir is allowed to drain the reservoir.

The software transfers the data automatically from the imaging software into an Excel spreadsheet. Time is transformed to square root time.

Methods for making throughdried tissues generally in accordance with this invention are described in U.S. Pat. No. 5,656,132 entitled "Soft Tissue" issued Aug. 12, 1997 to Farrington et al. and U.S. Pat. No. 5,672,248 entitled "Method of Making Soft Tissue Products" issued Sep. 30, 1997 to Wendt et al., both of which are hereby incorporated by reference.

The tissue sheets useful for purposes of this invention can have one, two, three or more plies and can be wet-pressed, throughdried, uncreped throughdried or wet molded and dried. They can be used for facial tissues, bath tissues, paper towels, dinner napkins and the like, although the greatest utility can be found in roll product forms such as bath tissue and paper towels.

made without the methods of this invention as described in Example 14, and a variety of commercially available paper towels (collectively labeled "C1" or "C2" depending upon whether or not they are 1- or 2-ply products, respectively), illustrating the combination of high roll bulk and high roll firmness attained by the products of this invention.

Figure 4:
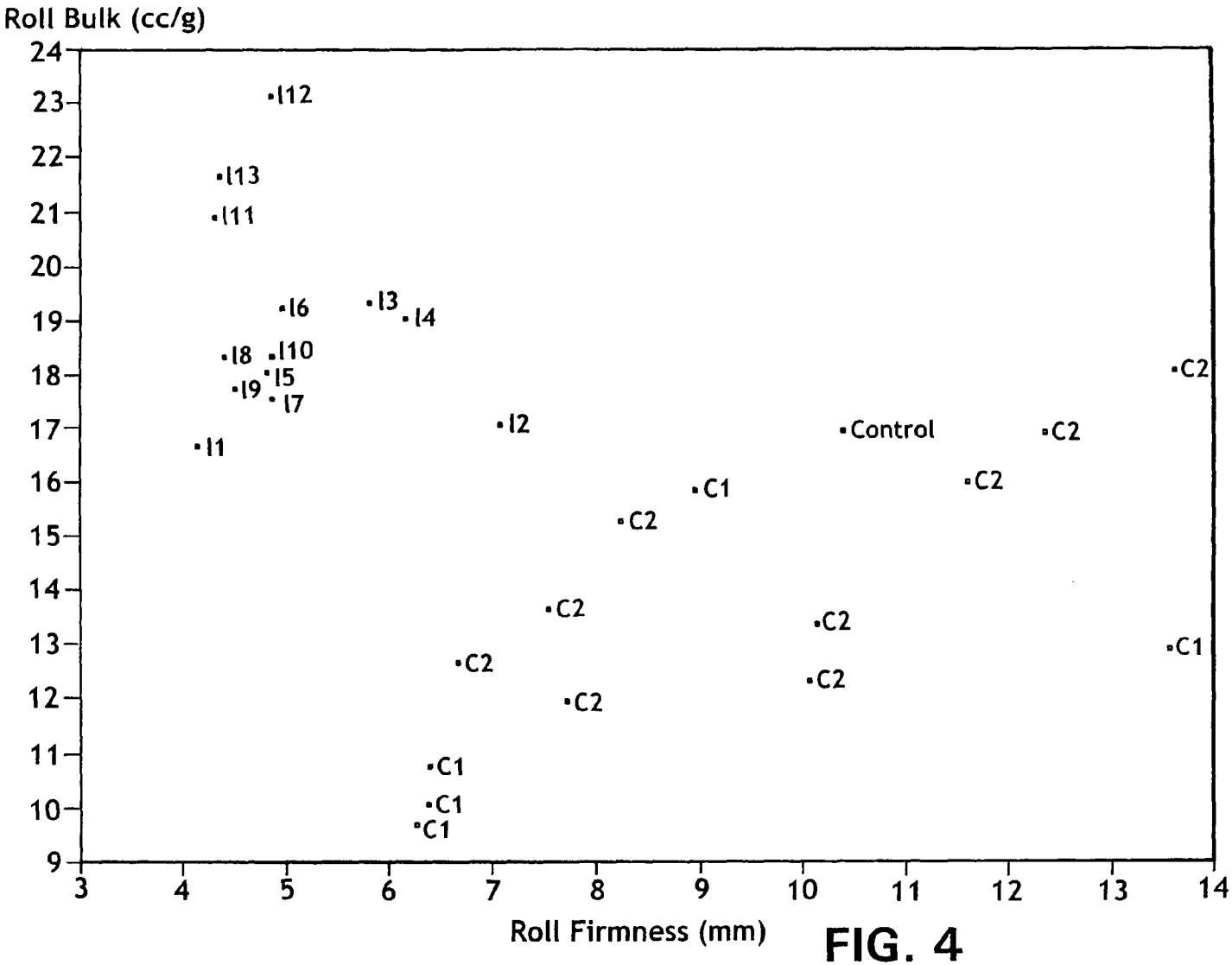
FIG. 4 is a plot of roll bulk versus roll firmness for products of this invention (labeled "I1"-"I13" corresponding to Examples 1-13 below), a control point (labeled "Control")
Figure 5:
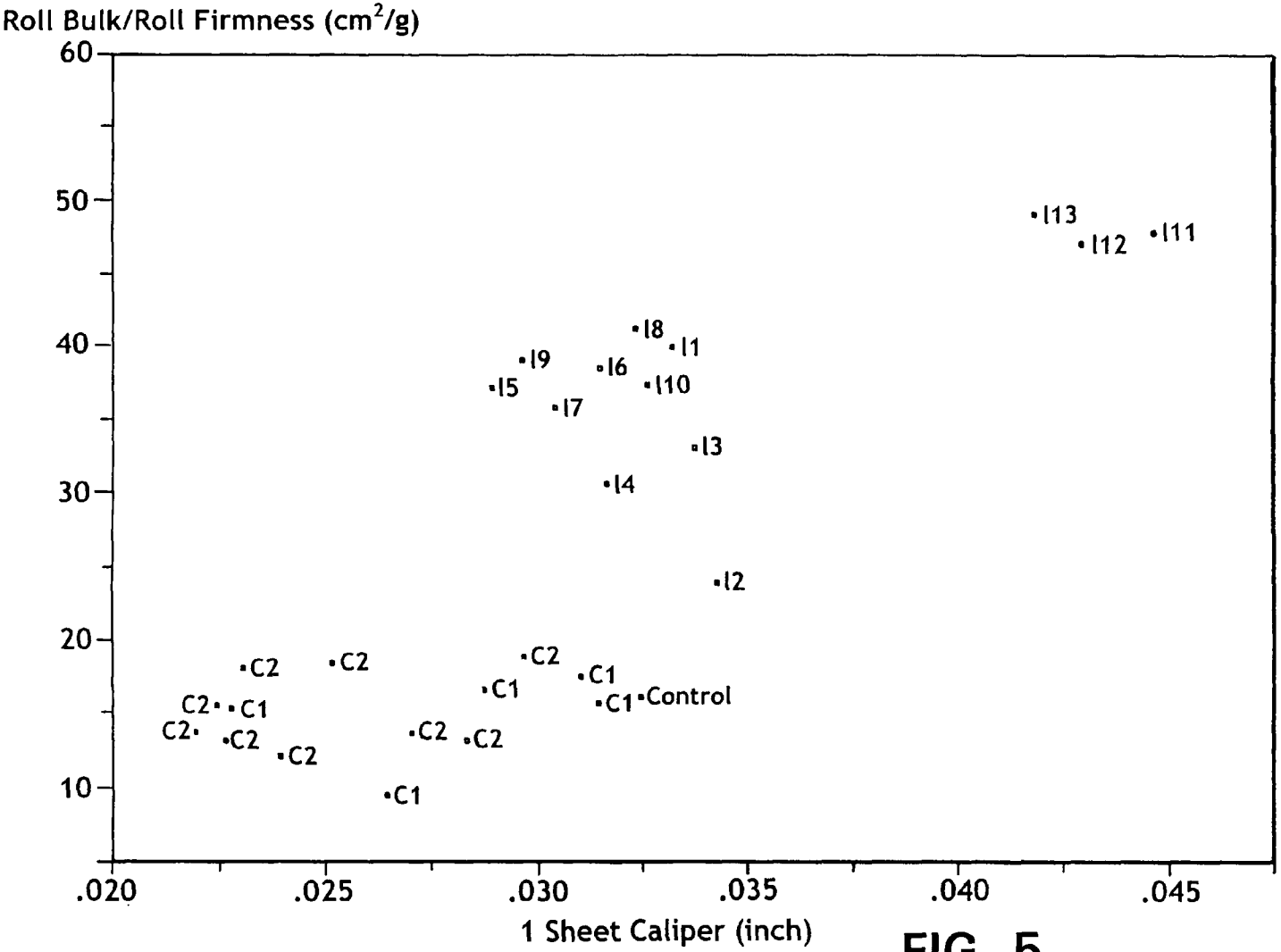

FIG. 5 is a plot of the roll bulk/roll firmness ratio versus single sheet caliper for products of this invention and a variety of commercially available paper towels with data points labeled as in FIG. 4, illustrating the efficiency of the methods of this invention for attaining firm, bulky rolls with tissue sheets of a given caliper.

Figure 6:
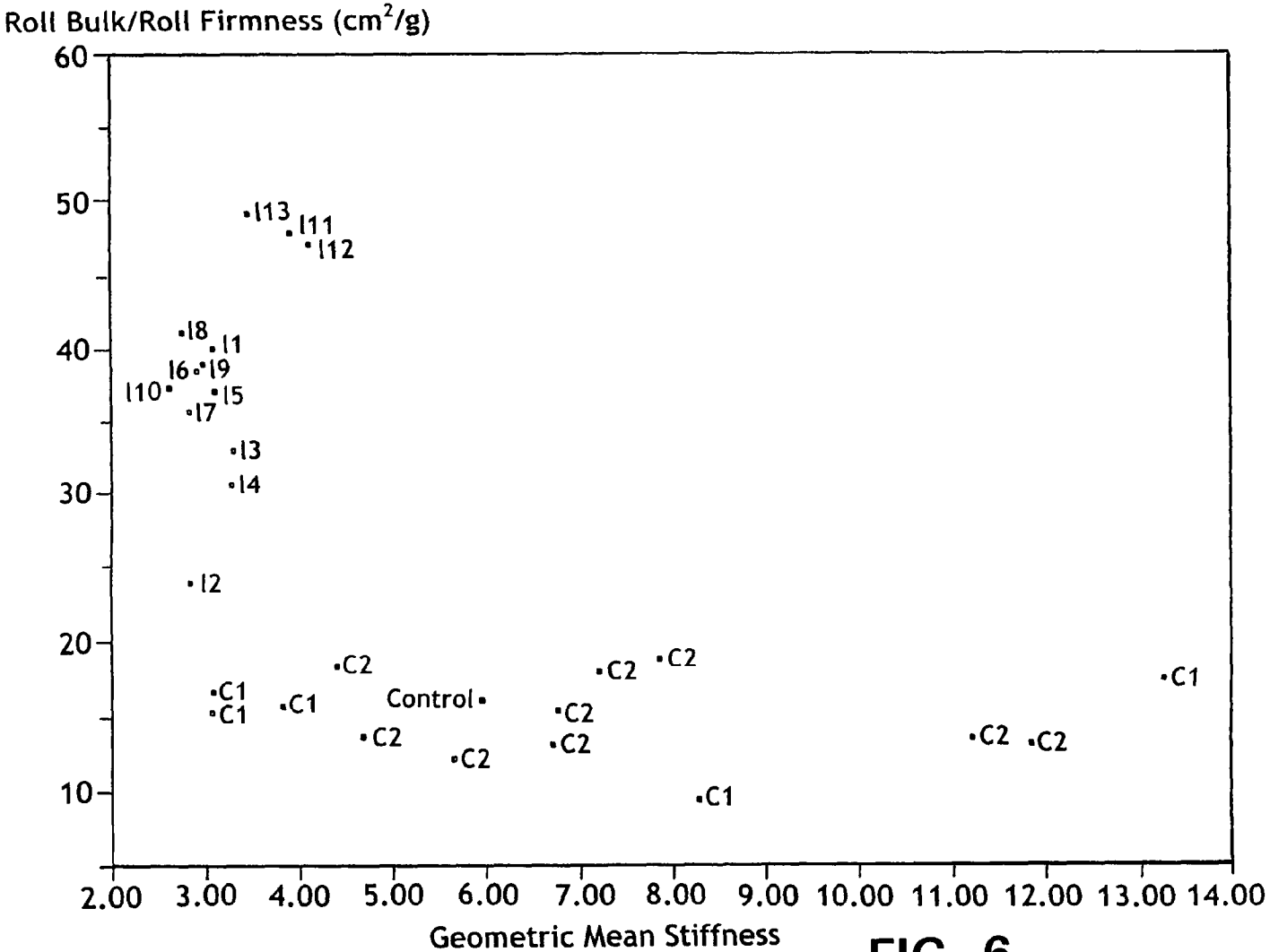

FIG. 6 is a plot of the roll bulk/roll firmness ratio versus the geometric mean stiffness, similar to FIGS. 4 and 5 above, illustrating the ability of the methods of this invention to provide a high degree of bulk and firmness with soft (less stiff) sheets.

Figure 7:
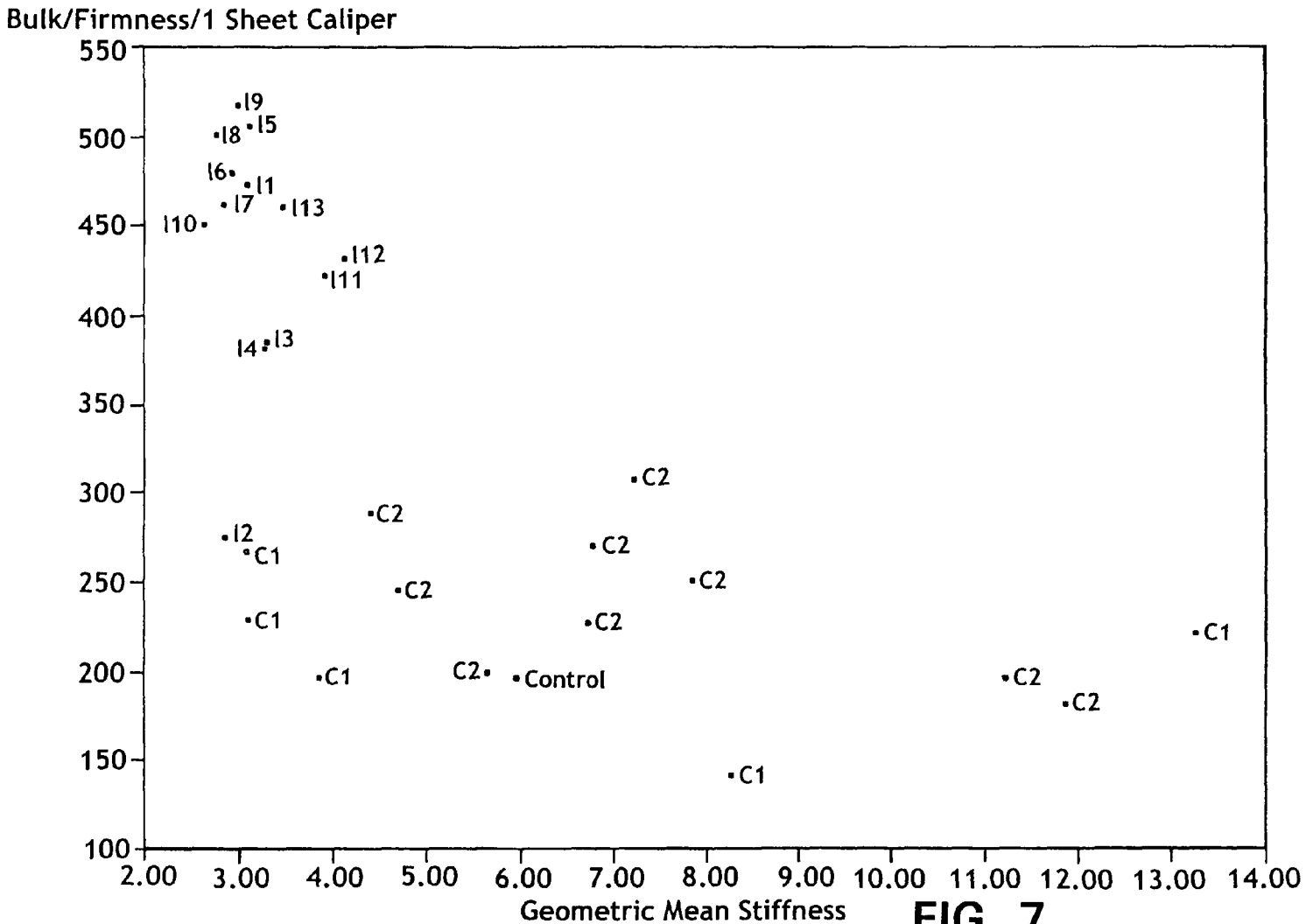

FIG. 7 is a plot of the roll bulk/roll firmness/single sheet caliper ratio versus the geometric mean stiffness, similar to FIGS. 4, 5 and 6 above, further illustrating the efficiency of the methods of this invention in providing quality bulk and firmness for soft tissue sheets of a given caliper.

Figure 8A:
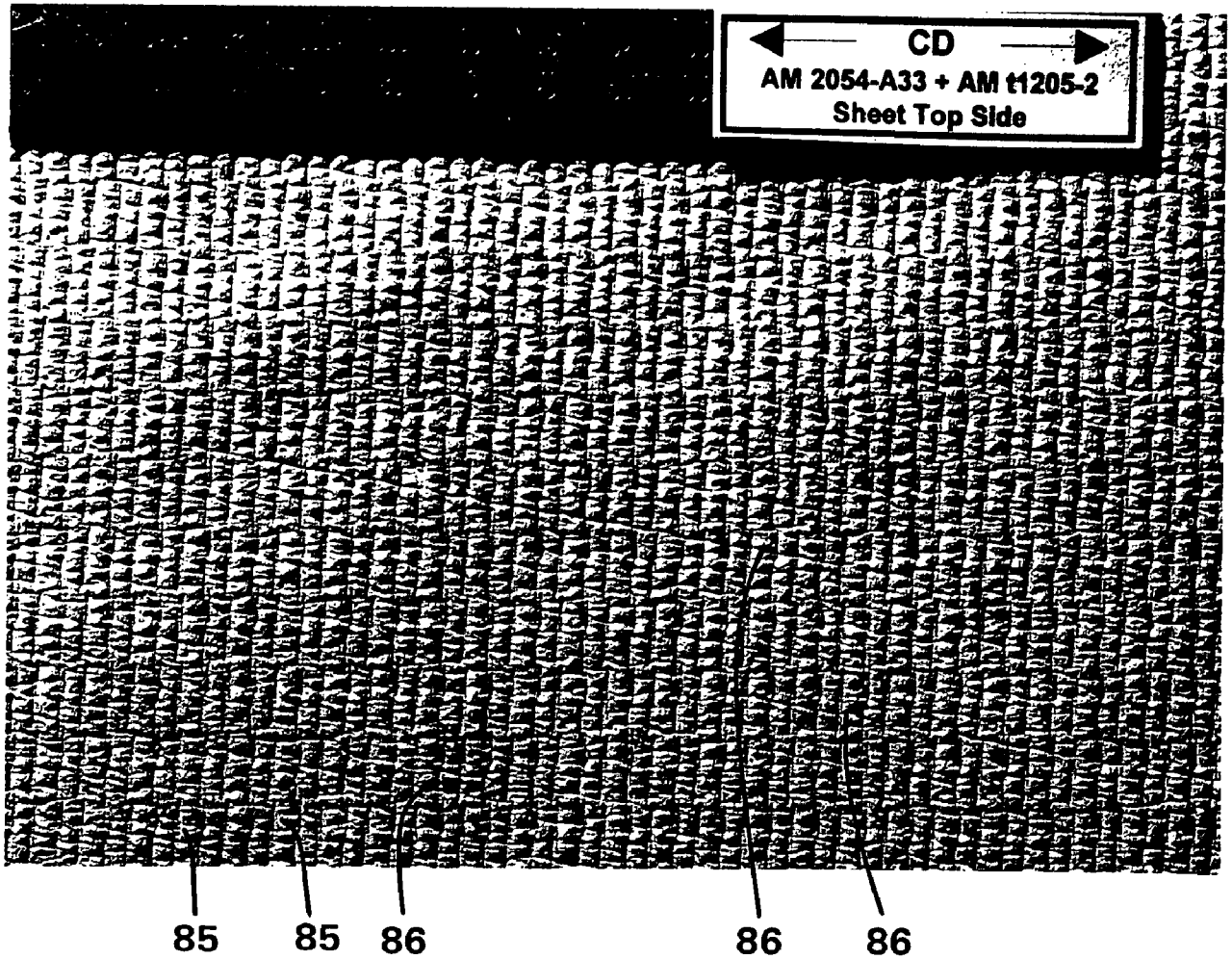
Figure 8B:
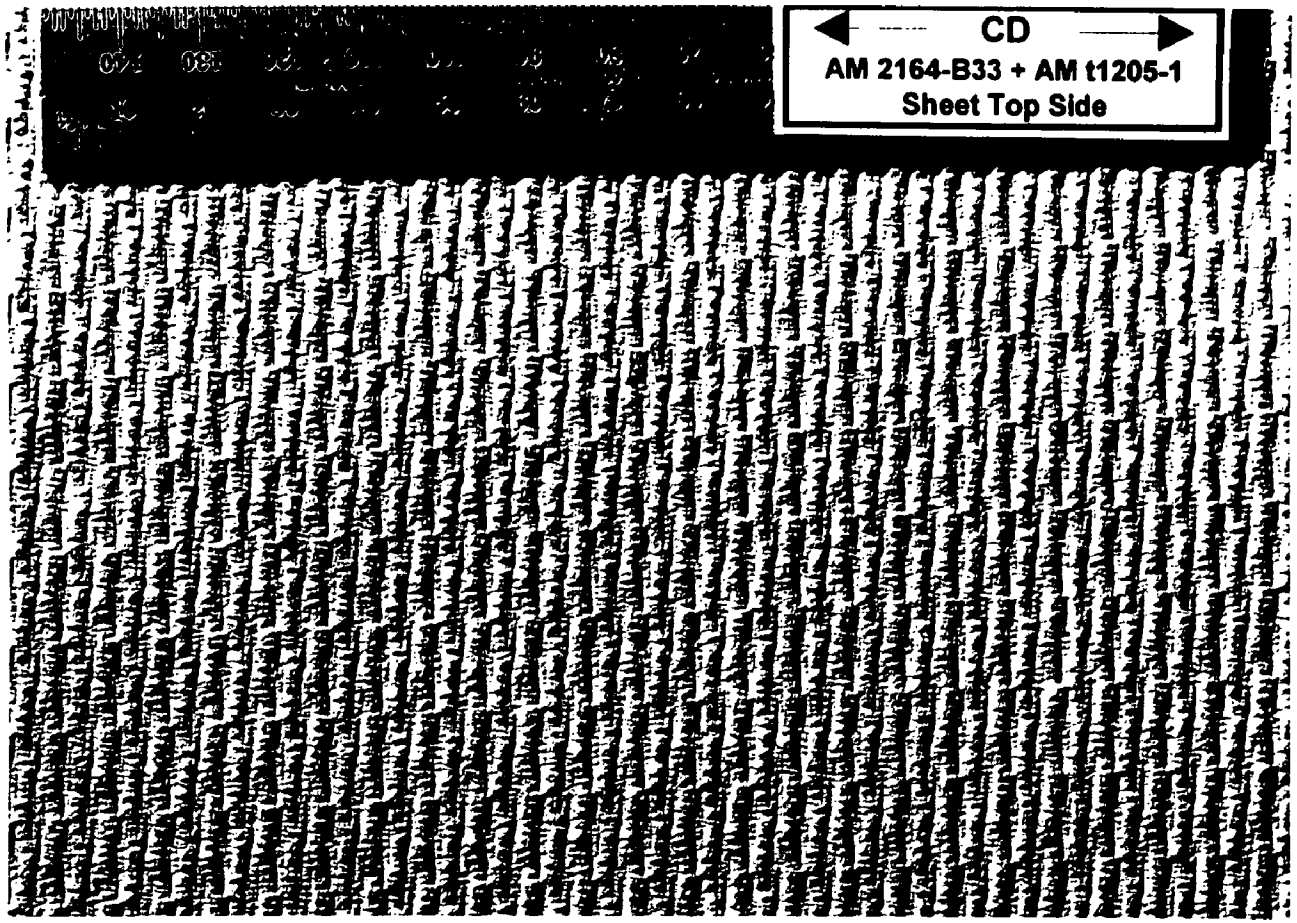

FIGS. 8A and 8B are photographs of the dryer side (top side) of an uncreped throughdried tissue sheet made in accordance with this invention and a similar sheet made without using the methods of this invention, respectively, illustrating the parallel rows of elevated pillow-like regions in the machine direction which are interrupted by the cross-machine direction dominant troughs imparted to the sheet by the transfer fabric.

Figure 9A:
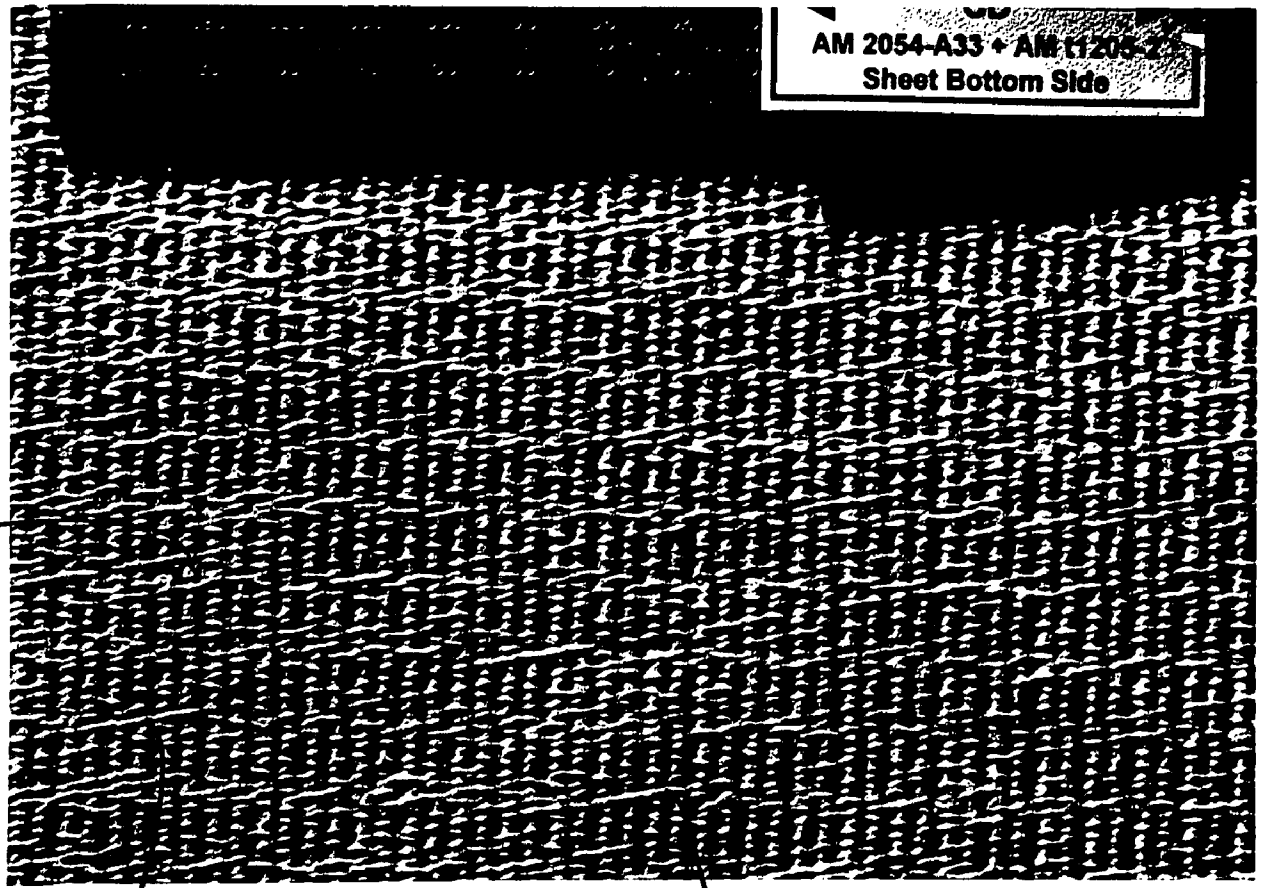
Figure 9B:
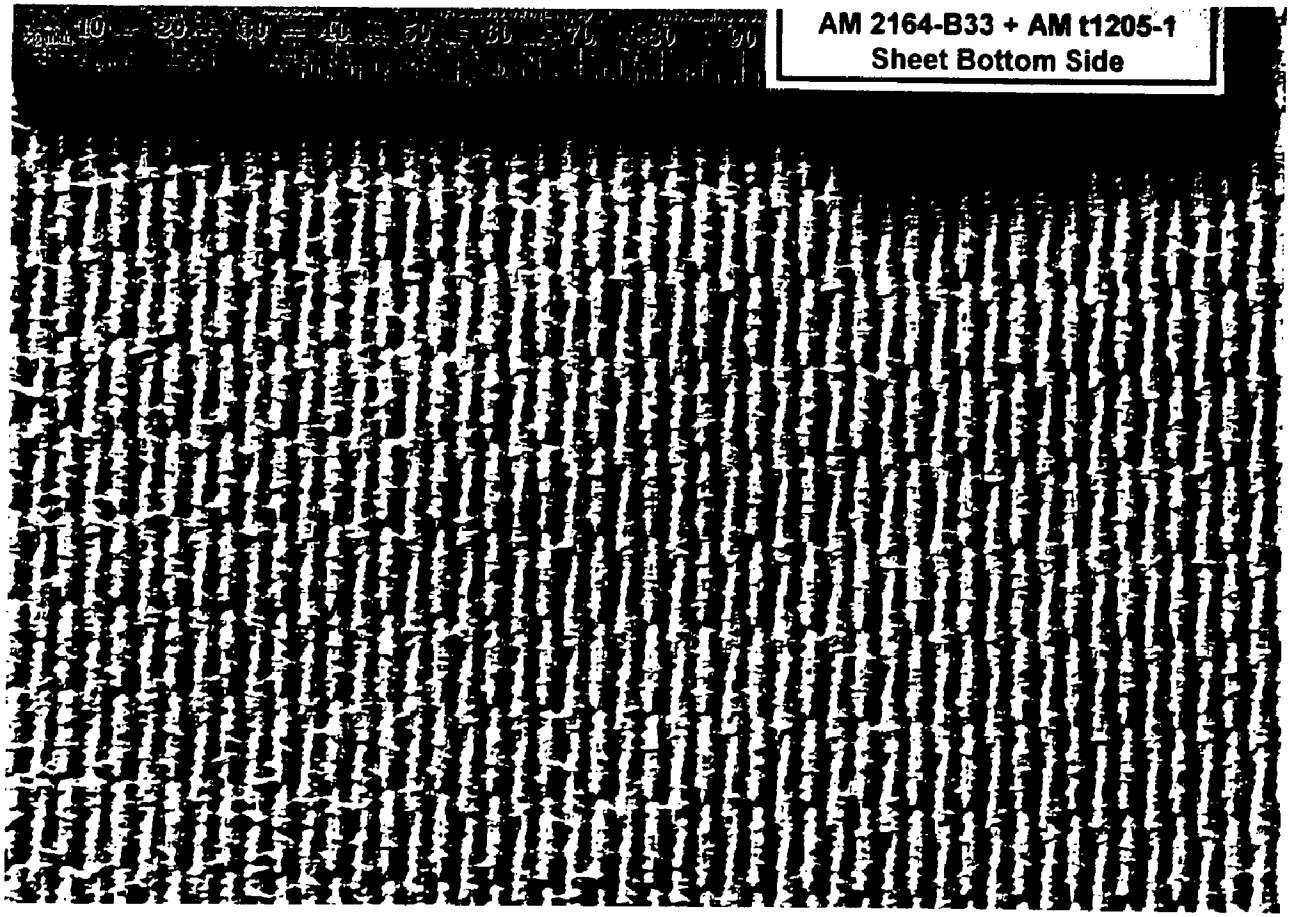

FIGS. 9A and 9B are photographs of the air side (bottom side) of the sheets of FIGS. 8A and 8B, respectively, further illustrating the bar-like impressions imparted to the tissue sheet by the transfer fabric, which on this side of the sheet are bar-like protrusions.

Figure 10:
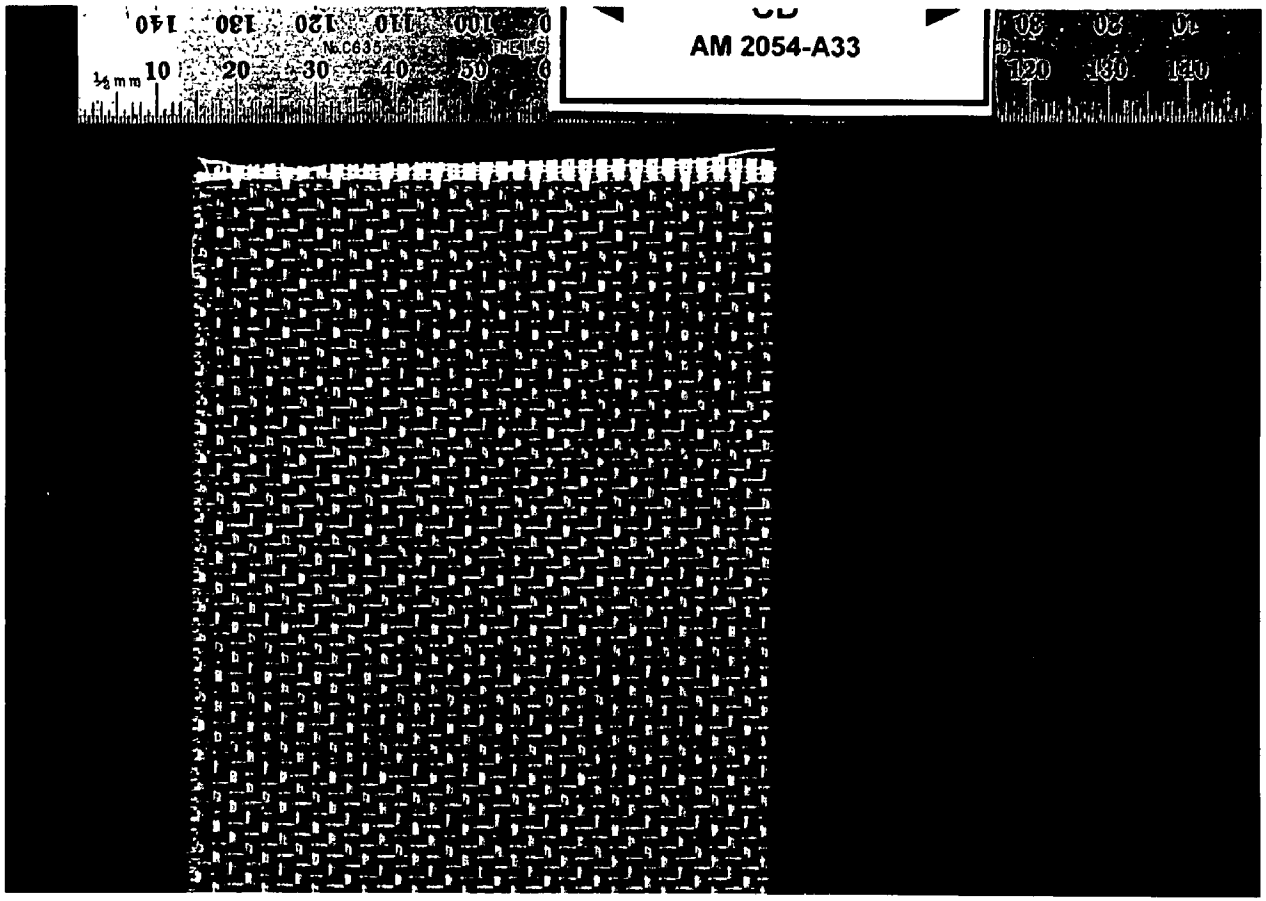

FIG. 10 is a photograph of the sheet side of a transfer fabric used to impart the bar-like protrusions in the air side of the sheet.

Figures 11A, 11B, 11C:
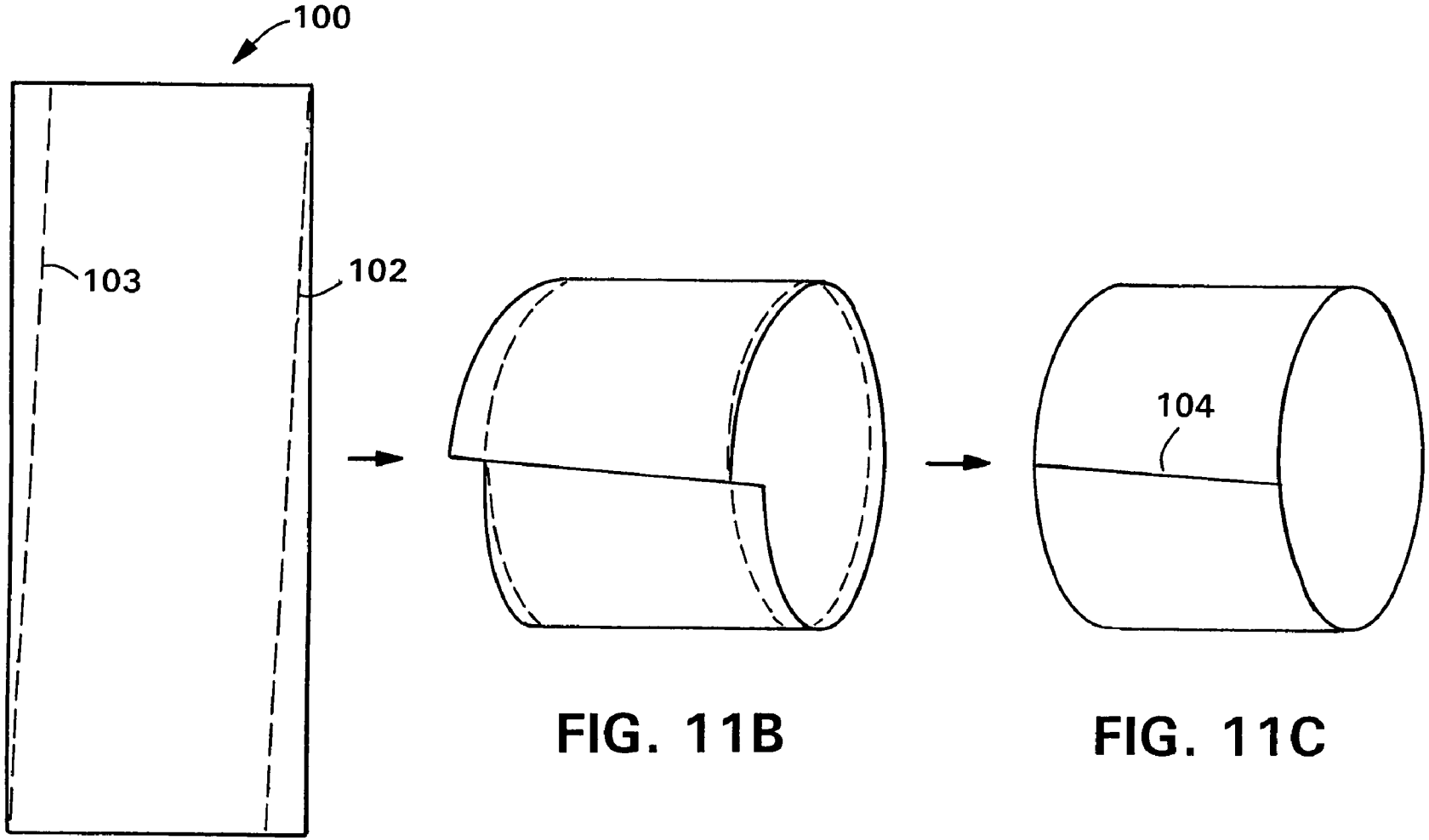

FIGS. 11A, 11B and 11C are schematic illustrations of the steps involved in a method of making an offset seam in a fabric used in accordance with an aspect of this invention.

Figure 12:
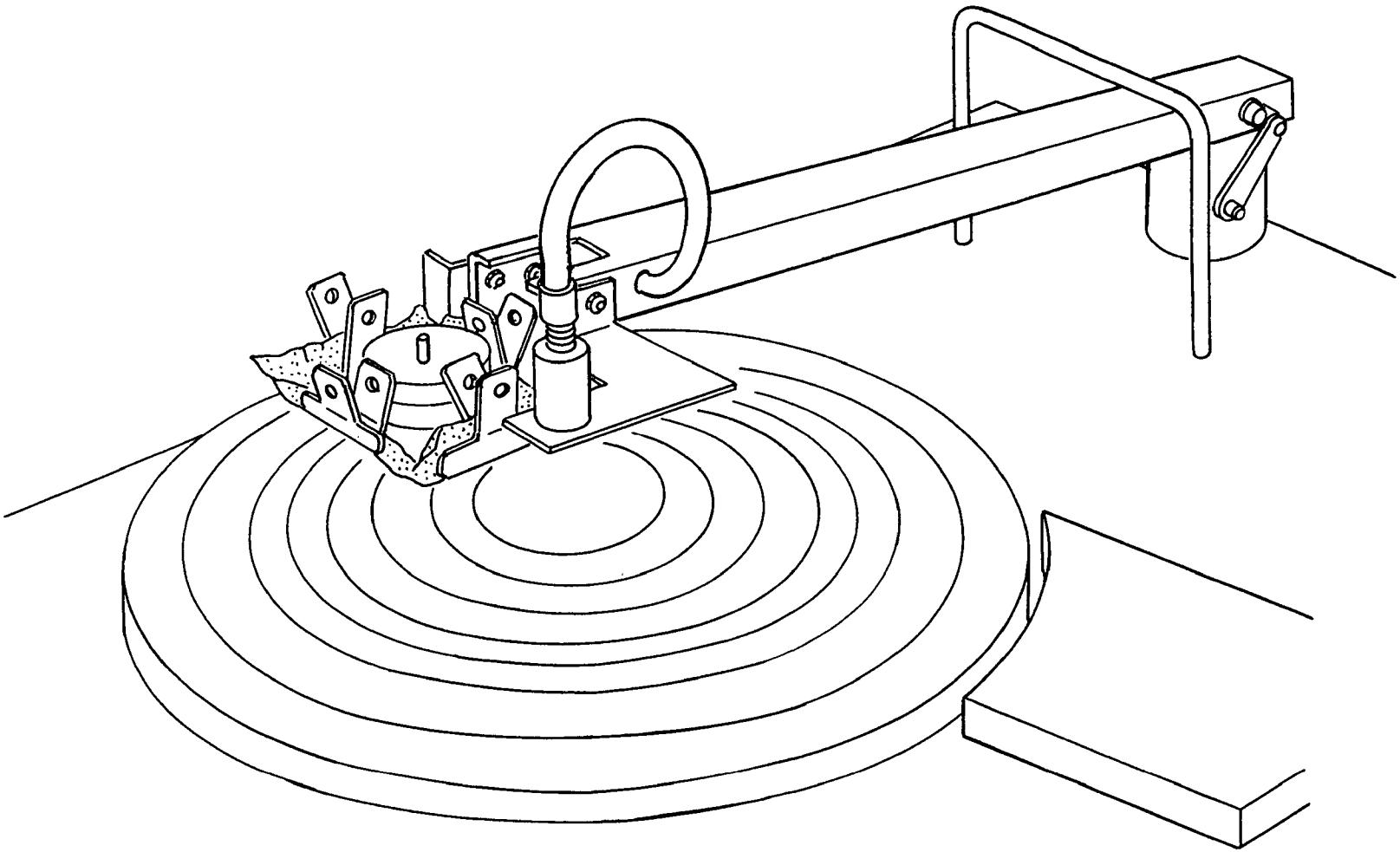

FIG. 12 is a schematic representation of the apparatus used to determine the Wipe Dry area.

Figure 13:
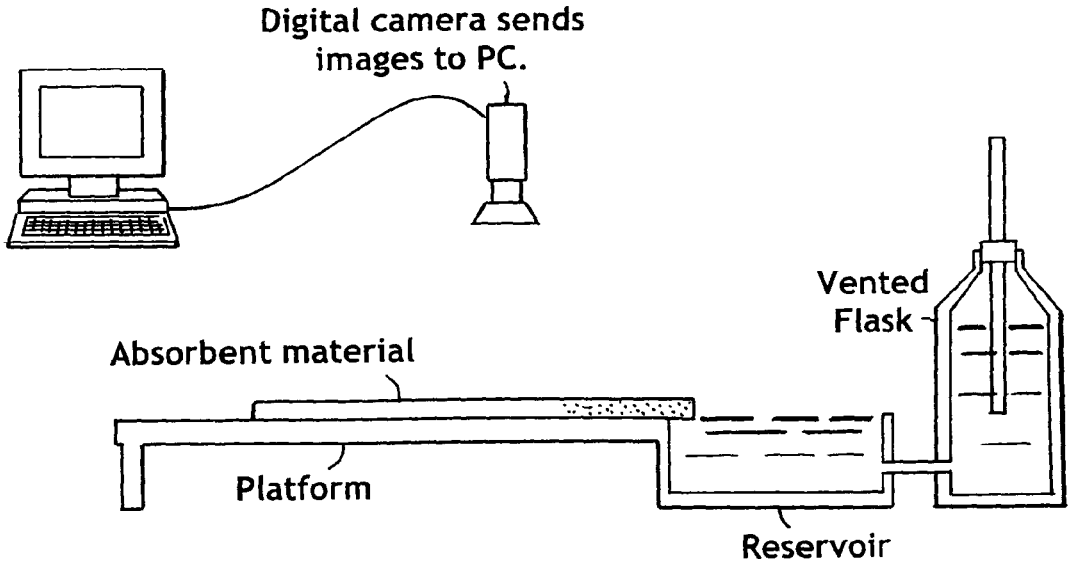

FIG. 13 is a schematic representation of the set-up used to determine the Horizontal Wicking rate.

Figure 14:
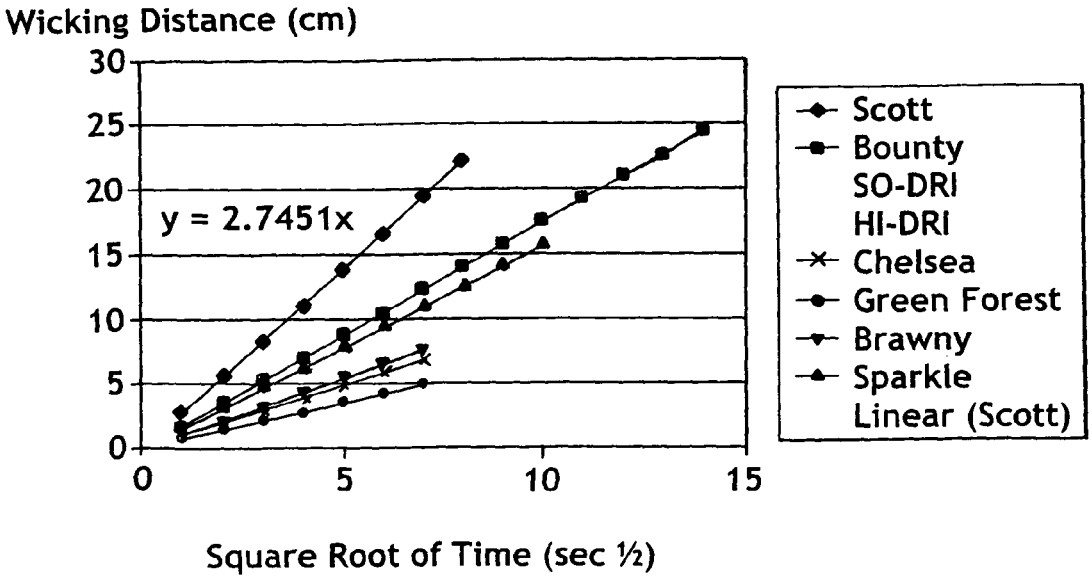

FIG. 14 is a plot of the Horizontal Wicking data for some commercially available paper towels including recently introduced products of this invention (Scott).

DETAILED DESCRIPTION OF THE DRAWINGS

Referring now to the drawings, the invention will be described in greater detail.

Figure 1:
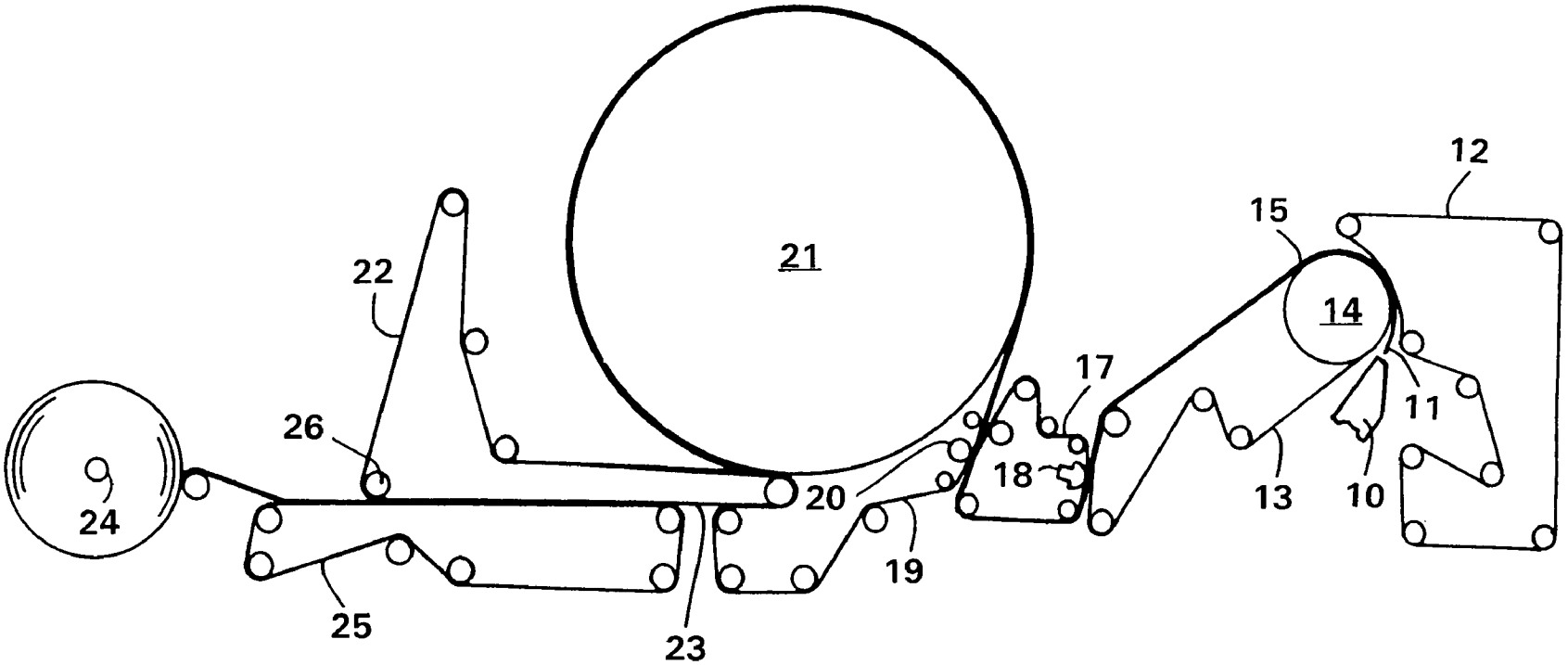
FIG. 1 illustrates a schematic view of the method for making uncreped throughdried tissues in accordance with this invention.

FIG. 1 illustrates a method of making an uncreped throughdried tissue sheet in accordance with this invention. Shown is a twin wire former having a layered papermaking headbox 10 which injects or deposits a stream 11 of an aqueous suspension of papermaking fibers between forming fabrics 12 and 13. The web is adhered to forming fabric 13, which serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased MD stretch into the web. A kiss transfer is carried out to avoid compression of the wet web, preferably with the assistance of a vacuum shoe 18. Depending upon the method used to impart the desired roll properties in accordance with this invention, the transfer fabric can be a fabric having high and long impression knuckles, generally as described in U.S. Pat. No. 5,672,248 to Wendt et al., previously mentioned, or it can have a smoother surface such as Asten 934, 937, 939, 959, Albany 94M or Appleton Mills 2164-B33. If the transfer fabric is being used to provide cross-machine direction dominant bars to the sheet, the transfer fabric can be as described in FIGS. 5, 6 and 7 of U.S. Pat. No. 5,219,004 entitled "Multi-ply Papermaking Fabric With Binder Warps" issued Jun. 15, 1993 to Chiu, which is hereby incorporated by reference. More particularly, referring to a transfer fabric as illustrated in FIG. 6 of Chiu, the sheet side of the transfer fabric is the side of the fabric having the long cross-machine direction dominant floats created by filaments 144, and the cross-machine dominant bars in the sheet imparted by the transfer fabric correspond to the troughs formed between cross-machine direction dominant filaments 144.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance. The throughdrying fabric is preferably of the high and long impression knuckle type generally described in Wendt et al.

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

Figure 2:
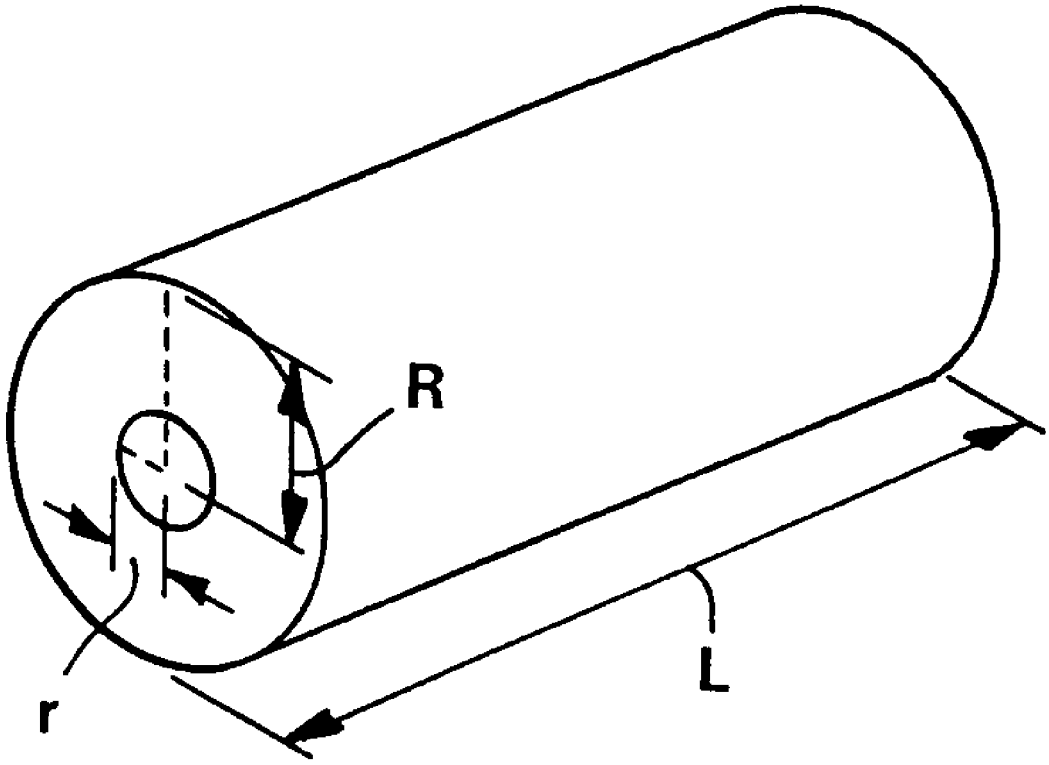
FIG. 2 is a schematic figure of a typical roll product, illustrating the calculation of "roll bulk".
Figure 3:
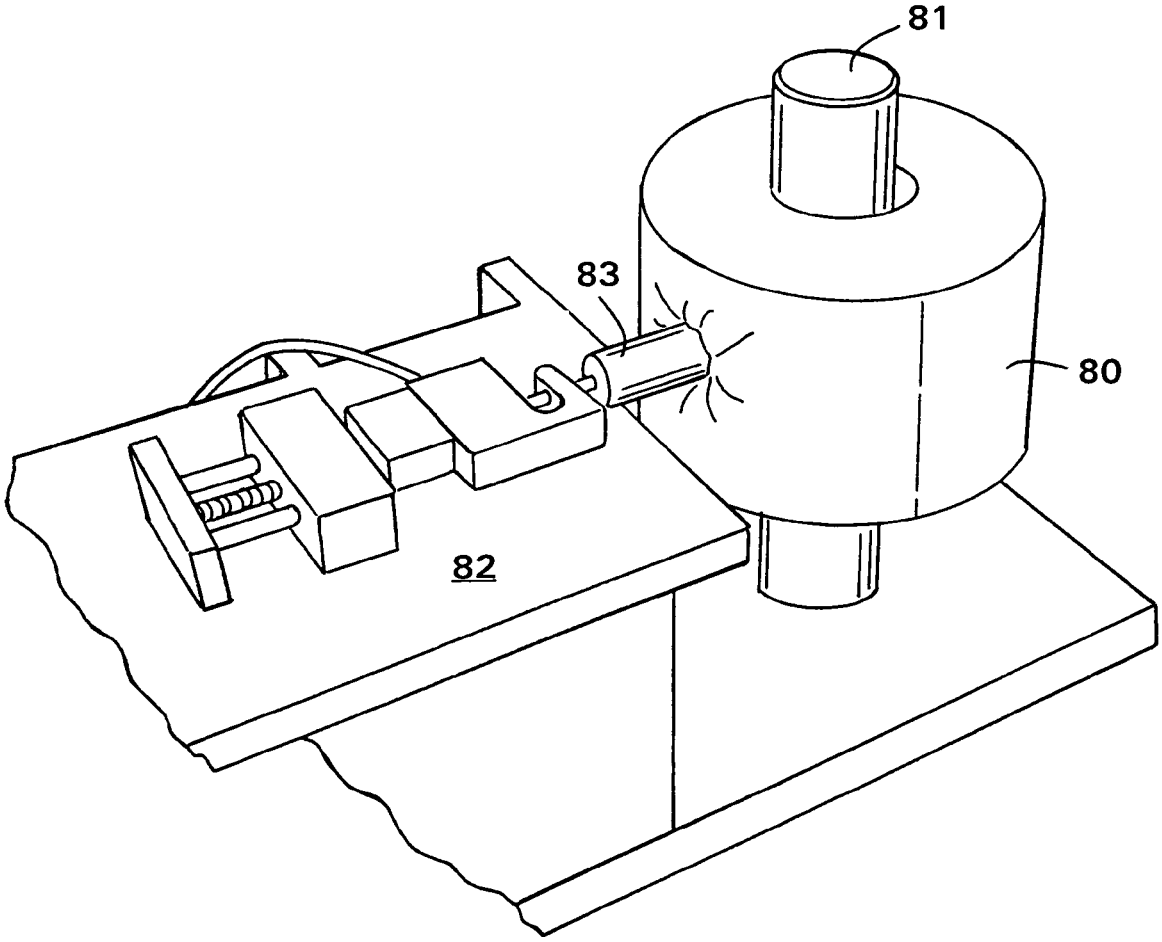
FIG. 3 is a schematic representation of the apparatus used for measuring "roll firmness".

FIGS. 2 and 3 have been previously described in connection with the roll bulk and roll firmness measurements.

FIGS. 4, 5, 6 and 7 are plots comparing certain properties of commercially available products with the products of this invention made in accordance with the Examples described below.

FIGS. 8A and 8B are photographs of the dryer side of an uncreped throughdried tissue sheet made in accordance with this invention (8A) and a similar sheet made without using the methods of this invention (8B). Referring to FIG. 8A, shown are the parallel rows of elevated pillow-like regions 85 running in the machine direction which are interrupted by the cross-machine direction dominant troughs 86 in the tissue sheet of this invention. In FIG. 8B, structure corresponding to the cross-machine dominant troughs is absent.

FIGS. 9A and 9B are photographs of the air side of the sheets of FIGS. 8A and 8B, respectively. Shown are the CD dominant bar-like protrusions 91 imparted to the air side of the tissue sheet by the transfer fabric.

FIG. 10 is a photograph of the sheet side of an Appleton Mills 2054-A33 transfer fabric used to impart the cross-machine direction dominant bar-like protrusions to the air side of the sheet illustrated in FIGS. 8A and 9A in accordance with an aspect of this invention.

FIGS. 11A, 11B and 11C are schematic diagrams illustrating the steps used to make a fabric with an offset seam for purposes of this invention. Initially, as shown in FIG. 11A, the fabric 100 is laid flat and the degree of offset is determined. Parallel offset lines 102 and 103 are drawn near the edges of the fabric as shown. The angle of these lines relative to the edge of the fabric represents the degree of offset relative to the machine direction of the fabric. The fabric is then formed into a continuous loop with the offset lines aligned as shown in FIG. 11B. The two adjacent edges of the fabric are then seamed together. The excess fabric material is then trimmed away using a hot knife or other suitable means, leaving an offset fabric as illustrated in FIG. 11C. As a result of this method, the seam 104 of the resulting fabric is not perpendicular to the machine direction of the fabric.

EXAMPLES

Example 1

An uncreped throughdried tissue sheet was made in accordance with this invention as described above in connection with FIG. 1. More specifically, a non-layered single ply towel tissue was made using a furnish comprising 50 dry weight percent northern softwood kraft fiber (NSWK), 25% northern softwood bleached chemi-thermomechanical fiber (BCTMP), and 25% southern hardwood kraft fiber (SHWK).

The NSWK fiber was pulped for 30 minutes at approximately 4 percent consistency and diluted to approximately 3.2 percent after pulping. The BCTMP and SHWK fibers were combined together in a 50:50 ratio and pulped for 30 minutes at approximately 4 percent consistency and diluted to approximately 3.2 percent after pulping. Kymene 557LX was added to both pulp streams at 10 kilograms per metric ton of pulp based on total flow. The NSWK fibers were refined at 1.0 horsepower-day (0.75 kW days) per metric ton. The pulp streams were then blended and diluted to approximately 0.18% consistency. The diluted suspension was fed to a C-wrap, twin wire, suction form roll, former with forming fabrics (12 and 13) being an Asten 867A and an Appleton Mills (AM) 2164-B33 fabric respectively. The speed of both of the forming fabrics was 1562 feet per minute (7.93 meters/second). The newly formed web was then de-watered to a consistency of about 24 percent using vacuum suction from below the forming fabric before being transferred to the transfer fabric (17) traveling at 1250 fpm (25% rush transfer.) The transfer fabric was an Appleton Mills 2054-A33 run with the coarse CD dominant filaments to the sheet side. (See FIG. 10). A vacuum shoe pulling 6 inches (152 millimeters) of mercury vacuum was used to transfer the web to the transfer fabric.

The web was then transferred to a throughdrying fabric (19), which was an Appleton Mills t1205-1. The through drying fabric was traveling at a speed of about 1250 feet per minute (6.35 meters/second). The web was carried over a Honeycomb through-dryer operating at a temperature of about 350° F. (177° C.) and dried to final dryness of about 97 percent consistency. The resulting uncreped tissue sheet was then calendered at a fixed gap of 0.011 inch (0.028 millimeter) between two 20 inches (508 millimeters) diameter steel rolls and wound into finished product rolls on 1.6 inches (40.6 millimeters) diameter cores.

The resulting finished product had the following properties: basis weight, 22.8 pounds per 2880 square feet (38.6 grams per square meter); MD tensile, 2480 grams per 3 inches (76.2 millimeters) sample width; CD tensile, 2370 grams per 3 inches (76.2 millimeters) sample width; MD stretch, 20.1 percent; CD stretch 9.0 percent; MD slope, 6.05 kilograms per 3 inches (76.2 millimeters) sample width; CD slope, 9.29 kilograms per 3 inches (76.2 millimeters) sample width; geometric mean stiffness, 3.10; single sheet caliper, 0.033 inch (0.84 millimeter); roll bulk, 16.7 cubic centimeters per gram; roll firmness, 4.16 millimeters; roll bulk divided by roll firmness, 40.1 square centimeters per gram; roll bulk divided by roll firmness divided by single sheet caliper, 480 centimeters per gram; absorbent capacity, 6.1 grams water per gram fiber; absorbent rate, 1.9 seconds; roll diameter, 5.19 inch (132 millimeters); roll length, 60.0 feet (18.3 meters).

Example 2

A single ply towel was made as described in Example 1 except the furnish consisted of 50 percent NSWK, 25% BCTMP, and 25% northern hardwood kraft fiber (NHWK), the NSWK was refined at 1.5 horsepower-days (1.1 kW) per metric ton, the throughdrying fabric was an Appleton Mills t1205-2 fabric, and the resulting basesheet was calendered at a fixed gap of 0.007 inch (0.178 millimeter).

The resulting finished product had the following properties: basis weight, 22.4 pounds per 2880 square feet (38.1 grams per square meter); MD tensile, 2540 grams per 3 inches (76.2 millimeters) sample width; CD tensile, 1680 grams per 3 inches (76.2 millimeters) sample width; MD stretch, 18.7 percent; CD stretch 10.3 percent; MD slope, 5.43 kilograms per 3 inches (76.2 millimeters) sample width; CD slope, 6.36 kilograms per 3 inches (76.2 millimeters) sample width; geometric mean stiffness, 2.84; single sheet caliper, 0.034 inch (0.86 mm); roll bulk, 17.1 cubic centimeters per gram; roll firmness, 7.1 millimeters; roll bulk divided by roll firmness, 24.1 square centimeters per gram; roll bulk divided by roll firmness divided by single sheet caliper, 280 centimeters per gram; absorbent capacity, 6.56 grams water per gram fiber; absorbent rate, 3.3 seconds; roll diameter, 5.20 inch (132 millimeters); roll length, 62.5 feet (19.1 meters).

Example 3

A single ply towel was made as described in Example 2 except the transfer fabric was an Appleton Mills t1605-2 fabric and the throughdrying fabric was an Appleton Mills t1205-2 off-seamed fabric at a finished offset angle of 0.273 degrees.

The resulting finished product had the following properties: basis weight, 21.8 pounds per 2880 square feet (37.1 grams per square meter); MD tensile, 2130 grams per 3 inches (76.2 millimeters) sample width; CD tensile, 1970 grams per 3 inches (76.2 millimeters) sample width; MD stretch, 17.5 percent; CD stretch 13.0 percent; MD slope, 9.13 kilograms per 3 inches (76.2 millimeters) sample width; CD slope, 5.06 kilograms per 3 inches (76.2 millimeters) sample width; geometric mean stiffness, 3.31; single sheet caliper, 0.034 (0.86 mm); roll bulk, 19.4 cubic centimeters per gram; roll firmness, 5.85 millimeters; roll bulk divided by roll firmness, 33.2 square centimeters per gram; roll bulk divided by roll firmness divided by single sheet caliper, 390 centimeters per gram; absorbent capacity, 6.78 grams water per gram fiber; absorbent rate, 2.2 seconds; roll diameter, 5.43 inch (138 millimeters); roll length, 62.5 feet (19.1 meters).

Example 4

A single ply towel was made as described in Example 3 except the resulting basesheet was calendered at a fixed gap of 0.005 inch (0.127 millimeter).

The resulting finished product had the following properties: basis weight, 21.6 pounds per 2880 square feet (36.7 grams per square meter); MD tensile, 2250 grams per 3 inches (76.2 millimeters) sample width; CD tensile, 1660 grams per 3 inches (76.2 millimeters) sample width; MD stretch, 18.5 percent; CD stretch 11.8 percent; MD slope, 8.98 kilograms per 3 inches (76.2 millimeters) sample width; CD slope, 4.47 kilograms per 3 inches (76.2 millimeters) sample width; geometric mean stiffness, 3.28; single sheet caliper, 0.032 inch (0.81 mm); roll bulk, 19.1 cubic centimeters per gram; roll firmness, 6.20 millimeters; roll bulk divided by roll firmness, 30.8 square centimeters per gram; roll bulk divided by roll firmness divided by single sheet caliper, 380 centimeters per gram; absorbent capacity, 6.83 grams water per gram fiber; absorbent rate, 2.1 seconds; roll diameter, 5.35 inch (136 millimeters); roll length, 62.5 feet (19.1 meters).

Example 5

A single ply towel was made as described in Example 3 except the NSWK was refined at 3.0 horsepower-days (2.2 kW days) per metric ton, Kymene 557LX was added at a rate of 12 kilograms per metric ton of fiber, the transfer fabric was an Appleton Mills t216-3 fabric, and the resulting basesheet was calendered at a fixed gap of 0.005 inch (0.127 millimeters).

The resulting finished product had the following properties: basis weight, 22.2 pounds per 2880 square feet (37.8 grams per square meter); MD tensile, 2870 grams per 3 inches (76.2 millimeters) sample width; CD tensile, 2460 grams per 3 inches (76.2 millimeters) sample width; MD stretch, 18.3 percent; CD stretch 11.3 percent; MD slope, 11.1 kilograms per 3 inches (76.2 millimeters) sample width; CD slope, 6.20 kilograms per 3 inches (76.2 millimeters) sample width; geometric mean stiffness, 3.12; single sheet caliper, 0.029 inch (0.74 mm); roll bulk, 18.1 cubic centimeters per gram; roll firmness, 4.85 millimeters; roll bulk divided by roll firmness, 37.3 square centimeters per gram; roll bulk divided by roll firmness divided by single sheet caliper, 500 centimeters per gram; absorbent capacity, 6.0 grams water per gram fiber; absorbent rate, 2.5 seconds; roll diameter, 5.32 inch (135 millimeters); roll length, 62.5 feet (19.1 meters).

Example 6

A single ply towel was made as described in Example 5 except the resulting basesheet was calendered at a fixed gap of 0.007 inch (0.178 millimeter).

The resulting finished product had the following properties: basis weight, 22.3 pounds per 2880 square feet (37.9 grams per square meter); MD tensile, 3330 grams per 3 inches (76.2 millimeters) sample width; CD tensile, 2610 grams per 3 inches (76.2 millimeters) sample width; MD stretch, 20.3 percent; CD stretch 11.7 percent; MD slope, 10.9 kilograms per 3 inches (76.2 millimeters) sample width; CD slope, 6.85 kilograms per 3 inches (76.2 millimeters) sample width; geometric mean stiffness, 2.92; single sheet caliper, 0.032 inch (0.81 mm); roll bulk, 19.3 cubic centimeters per gram; roll firmness, 5.0 millimeters; roll bulk divided by roll firmness, 38.6 square centimeters per gram; roll bulk divided by roll firmness divided by single sheet caliper, 480 centimeters per gram; absorbent capacity, 6.14 grams water per gram fiber; absorbent rate, 2.5 seconds; roll diameter, 5.47 inch (139 millimeters); roll length, 62.5 feet (19.1 meters).

Example 7

A single ply towel was made as described in Example 5 except the transfer fabric was an Appleton Mills 2054-A33.

The resulting finished product had the following properties: basis weight, 22.1 pounds per 2880 square feet (37.6 grams per square meter); MD tensile, 3260 grams per 3 inches (76.2 millimeters) sample width; CD tensile, 2120 grams per 3 inches (76.2 millimeters) sample width; MD stretch, 19.1 percent; CD stretch 9.4 percent; MD slope, 5.98 kilograms per 3 inches (76.2 millimeters) sample width; CD slope, 9.4 kilograms per 3 inches (76.2 millimeters) sample width; geometric mean stiffness, 2.85; single sheet caliper, 0.031 inch (0.79 mm); roll bulk, 17.6 cubic centimeters per gram; roll firmness, 4.90 millimeters; roll bulk divided by roll firmness, 35.9 square centimeters per gram; roll bulk divided by roll firmness divided by single sheet caliper, 460 centimeters per gram; absorbent capacity, 5.86 grams water per gram fiber; absorbent rate, 2.74 seconds; roll diameter, 5.24 inch (133 millimeters); roll length, 62.5 feet (19.1 meters).

Example 8

A single ply towel was made as described in Example 7 except the resulting basesheet was calendered at a fixed gap of 0.007 inch (0.178 millimeter).

The resulting finished product had the following properties: basis weight, 22.3 pounds per 2880 square feet (37.9 grams per square meter); MD tensile, 3330 grams per 3 inches (76.2 millimeters) sample width; CD tensile, 2270 grams per 3 inches (76.2 millimeters) sample width; MD stretch, 17.4 percent; CD stretch 10.5 percent; MD slope, 6.6 kilograms per 3 inches (76.2 millimeters) sample width; CD slope, 8.8 kilograms per 3 inches (76.2 millimeters) sample width; geometric mean stiffness, 2.8; single sheet caliper, 0.032 inch (0.81 mm); roll bulk, 18.4 cubic centimeters per gram; roll firmness, 4.45 millimeters; roll bulk divided by roll firmness, 41.3 square centimeters per gram; roll bulk divided by roll firmness divided by single sheet caliper, 510 centimeters per gram; absorbent capacity, 5.98 grams water per gram fiber; absorbent rate, 3.0 seconds; roll diameter, 5.35 inch (136 millimeters); roll length, 62.5 feet (19.1 meters).

Example 9

A single ply towel was made as described in Example 7 except the former consistency was approximately 0.25 percent.

The resulting finished product had the following properties: basis weight, 22.2 pounds per 2880 square feet (37.8 grams per square meter); MD tensile, 2940 grams per 3 inches (76.2 millimeters) sample width; CD tensile, 2210 grams per 3 inches (76.2 millimeters) sample width; MD stretch, 16.5 percent; CD stretch 10.0 percent; MD slope, 6.65 kilograms per 3 inches (76.2 millimeters) sample width; CD slope, 8.50 kilograms per 3 inches (76.2 millimeters) sample width; geometric mean stiffness, 3.00; single sheet caliper, 0.030 inch (0.76 mm); roll bulk, 17.8 cubic centimeters per gram; roll firmness, 4.55 millimeters; roll bulk divided by roll firmness, 39.1 square centimeters per gram; roll bulk divided by roll firmness divided by single sheet caliper, 520 centimeters per gram; absorbent capacity, 6.0 grams water per gram fiber; absorbent rate, 2.8 seconds; roll diameter, 5.28 inch (134 millimeters); roll length, 62.5 feet (19.1 meters).

Example 10

A single ply towel as described in Example 9 except the resulting basesheet was calendered at a fixed gap of 0.007 inch (0.178 millimeter).

The resulting finished product had the following properties: basis weight, 22.3 pounds per 2880 square feet (37.8 grams per square meter); MD tensile, 3220 grams per 3 inches (76.2 millimeters) sample width; CD tensile, 2370 grams per 3 inches (76.2 millimeters) sample width; MD stretch, 18.5 percent; CD stretch 10.5 percent; MD slope, 6.06 kilograms per 3 inches (76.2 millimeters) sample width; CD slope, 8.67 kilograms per 3 inches (76.2 millimeters) sample width; geometric mean stiffness, 2.63; single sheet caliper, 0.033 inch (0.84 mm); roll bulk, 18.4 cubic centimeters per gram; roll firmness, 4.9 millimeters; roll bulk divided by roll firmness, 37.6 square centimeters per gram; roll bulk divided by roll firmness divided by single sheet caliper, 450 centimeters per gram; absorbent capacity, 5.89 grams water per gram fiber; absorbent rate, 2.8 seconds; roll diameter, 5.35 inch (136 millimeters); roll length, 62.5 feet (19.1 meters).

Example 11

A single ply towel was made as described in Example 2 except the resulting basesheet was not calendered.

The resulting finished product had the following properties: basis weight, 23.6 pounds per 2880 square feet (40.1 grams per square meter); MD tensile, 2570 grams per 3 inches (76.2 millimeters) sample width; CD tensile, 2290 grams per 3 inches (76.2 millimeters) sample width; MD stretch, 19.9 percent; CD stretch 12.6 percent; MD slope, 8.98 kilograms per 3 inches (76.2 millimeters) sample width; CD slope, 10.2 kilograms per 3 inches (76.2 millimeters) sample width; geometric mean stiffness, 3.93; single sheet caliper, 0.045 inch (1.14 mm); roll bulk, 20.9 cubic centimeters per gram; roll firmness, 4.35 millimeters; roll bulk divided by roll firmness, 48.1 square centimeters per gram; roll bulk divided by roll firmness divided by single sheet caliper, 420 centimeters per gram; absorbent capacity, 6.56 grams water per gram fiber; absorbent rate, 3.2 seconds; roll diameter, 5.95 inch (151 millimeters); roll length, 65.0 feet (19.7 meters).

Example 12

A single ply towel as described in Example 3 except the resulting basesheet was not calendered.

The resulting finished product had the following properties: basis weight, 22.5 pounds per 2880 square feet (38.3 grams per square meter); MD tensile, 2600 grams per 3 inches (76.2 millimeters) sample width; CD tensile, 2410 grams per 3 inches (76.2 millimeters) sample width; MD stretch, 19.6 percent; CD stretch 13.2 percent; MD slope, 12.3 kilograms per 3 inches (76.2 millimeters) sample width; CD slope, 8.74 kilograms per 3 inches (76.2 millimeters) sample width; geometric mean stiffness, 4.13; single sheet caliper, 0.043 inch (1.09 mm); roll bulk, 23.2 cubic centimeters per gram; roll firmness, 4.9 millimeters; roll bulk divided by roll firmness, 47.3 square centimeters per gram; roll bulk divided by roll firmness divided by single sheet caliper, 430 centimeters per gram; absorbent capacity, 6.41 grams water per gram fiber; absorbent rate, 2.2 seconds; roll diameter, 6.1 inch (155 millimeters); roll length, 65.1 feet (19.7 meters).

Example 13

A single ply towel as described in Example 7 except the resulting basesheet was not calendered.

The resulting finished product had the following properties: basis weight, 22.7 pounds per 2880 square feet (38.6 grams per square meter); MD tensile, 3430 grams per 3 inches (76.2 millimeters) sample width; CD tensile, 2620 grams per 3 inches (76.2 millimeters) sample width; MD stretch, 21.6 percent; CD stretch 10.7 percent; MD slope, 7.67 kilograms per 3 inches (76.2 millimeters) sample width; CD slope, 14.2 kilograms per 3 inches (76.2 millimeters) sample width; geometric mean stiffness, 3.46; single sheet caliper, 0.042 inch (1.07 mm); roll bulk, 21.7 cubic centimeters per gram; roll firmness, 4.40 millimeters; roll bulk divided by roll firmness, 49.2 square centimeters per gram; roll bulk divided by roll firmness divided by single sheet caliper, 460 centimeters per gram; absorbent capacity, 5.98 grams water per gram fiber; absorbent rate, 2.8 seconds; roll diameter, 5.90 inch (150 millimeters); roll length, 63.5 feet (19.2 meters).

Example 14

Control

A single ply towel as described in Example 1 except the transfer fabric was an AM 2164-B33 and the resulting basesheet was calendered at a fixed gap of 0.011 inch (27.9 mm).

The resulting finished product had the following properties: basis weight, 22.4 pounds per 2880 square feet (38.1 grams per square meter); MD tensile, 2670 grams per 3 inches (76.2 millimeters) sample width; CD tensile, 2170 grams per 3 inches (76.2 millimeters) sample width; MD stretch, 19.1 percent; CD stretch 9.0 percent; MD slope, 19.6 kilograms per 3 inches (76.2 millimeters) sample width; CD slope, 10.6 kilograms per 3 inches (76.2 millimeters) sample width; geometric mean stiffness, 5.98; single sheet caliper, 0.033 inch (0.84 mm); roll bulk, 17.0 cubic centimeters per gram; roll firmness, 10.4 millimeters; roll bulk divided by roll firmness, 16.3 square centimeters per gram; roll bulk divided by roll firmness divided by single sheet caliper, 200 centimeters per gram; absorbent capacity, 6.0 grams water per gram fiber; absorbent rate, 2.0 seconds; roll diameter, 5.19 inch (1325 millimeters); roll length, 60.0 feet (18.2 meters).

Example 15

A single ply towel as described in Example 1 except the SHWK was replaced with unrefined NSWK, the former was a Beloit suction roll former, the forming fabric was AM 2164-A33, the furnish contained 10% own-make broke, Kymene 557LX was added at only 7 kg/mton, carrier fabrics 22 and 25 were not in place, the base sheet was calendered with steel/steel rolls at a fixed gap of 0.015 inches, and the finished product was calendered with steel/steel rolls at a fixed gap of 0.008 inches.

The resulting finished product had the following properties: basis weight 25.0 pounds per 2880 square feet; MD tensile, 2950 grams per 3 inch width; CD tensile, 2450 grams per 3 inch width; MD stretch, 19.5 percent; CD stretch, 9.5%; MD slope 9.4 kilograms per 3 inches, CD slope 9.3 kilograms per 3 inches, geometric mean stiffness 3.48, single sheet caliper, 0.032 inch; roll bulk, 16.1 cubic centimeters per gram; roll firmness, 4.50 millimeters; roll bulk divided by roll firmness, 35.8 square centimeters per gram; roll bulk divided by roll firmness divided by single sheet caliper, 440 centimeters per gram; absorbent capacity, 5.9 grams water per gram fiber; absorbent rate, 2.2 seconds; roll diameter, 5.30 inch; roll length, 62 feet; wipe-dry, 983; horizontal wicking rate, 2.86 centimeters per sec½.

The following Table summarizes the properties of current competitive products for comparison.

TABLE 1

1Q1998 averages

| current commercial towels | mfg. | basis wt. lbs/2880 ft2 | MD tensile grams/3" | CD tensile grams/3" | MD stretch percent | CD stretch percent |
|---|---|---|---|---|---|---|
| Bounty | Procter & Gamble | 25.3 | 3105 | 2334 | 12.5 | 9.2 |
| Sparkle | Georgia-Pacific | 26.8 | 3281 | 2572 | 9.9 | 4 |
| Brawny | Ft. James | 30 | 3802 | 2607 | 14.1 | 4.1 |
| Green Forest | Ft. James | 29.2 | 3508 | 2682 | 12.3 | 5.4 |
| So-Dri | Ft. James | 28.6 | 3467 | 2726 | 9.5 | 4 |
| Hi-Dri | Kimberly-Clark | 19.7 | 2190 | 1147 | 11.7 | 6.7 |
| Chelsea | Ft. James | 28.6 | 3766 | 2293 | 18.5 | 4.7 |

| current commercial towels | mfg. | MD slope kg/3" | CD slope kg/3" | geometric mean stiffness | single sheet caliper inches | roll bulk cc/gram | roll firmness millimeters |
|---|---|---|---|---|---|---|---|
| Bounty | Procter & Gamble | 16.76 | 15.96 | 6.1 | 0.0254 | 15.6 | 8.61 |
| Sparkle | Georgia-Pacific | 29.43 | 40.31 | 11.9 | 0.0221 | 13.3 | 8.71 |
| Brawny | Ft. James | 24.94 | 39.96 | 10 | 0.0243 | 12.2 | 8.99 |
| Green Forest | Ft. James | 16.3 | 27.76 | 6.9 | 0.0263 | 15.4 | 9.45 |
| So-Dri | Ft. James | 24.76 | 37.18 | 9.9 | 0.0275 | 16.3 | 8.73 |
| Hi-Dri | Kimberly-Clark | 21.91 | 22.82 | 14.1 | 0.0256 | 18.2 | 11.04 |
| Chelsea | Ft. James | 21.94 | 39.51 | 12.6 | 0.023 | 10.7 | 7.36 |

| current commercial towels | mfg. | roll bulk divided by roll firmness cm2/gram | roll bulk divided by roll firmness divided by single sheet caliper cm./gram | absorbent capacity g. water divided by g. fiber | absorbent rate seconds | wipe-dry cm2 | horizontal wicking rate cm/sec1/2 |
|---|---|---|---|---|---|---|---|
| Bounty | Procter & Gamble | 18.1184669 | 280.8367986 | 10.16 | 3.5 | 233 | 1.73 |
| Sparkle | Georgia-Pacific | 15.26980482 | 272.0241711 | 4.65 | 3.1 | 0 | 1.55 |
| Brawny | Ft. James | 13.57063404 | 219.8670496 | 4.15 | 4.5 | 383 | 1.1 |
| Green Forest | Ft. James | 16.2962963 | 243.9492275 | 4.34 | 6.1 | 208 | 0.64 |
| So-Dri | Ft. James | 18.67124857 | 267.3049187 | 4.2 | 6.1 | 67 | 0.64 |
| Hi-Dri | Kimberly-Clark | 16.48550725 | 253.5295775 | 4.88 | 2.9 | 0 | 0.56 |
| Chelsea | Ft. James | 14.53804348 | 248.8538767 | 4.58 | 4.4 | 0 | 0.99 |

It will be appreciated that the foregoing examples, given for purposes of illustration, are not to be construed as limiting the scope of this invention, which is defined by the following claims and all equivalents thereto.

We claim:

1. A throughdried tissue sheet having an air side and a dryer side, the dryer side of the sheet having parallel discontinuous rows of machine direction dominant elevated ridges, wherein the discontinuities in the rows of elevated ridges are cross-machine dominant linear protrusions on the air side of the sheet.

2. The tissue sheet of claim 1 wherein the rows of elevated ridges are imparted to the sheet by spaces between machine-direction dominant knuckles in a throughdryer fabric.

3. The tissue sheet of claim 1 wherein the cross-machine dominant linear protrusions on the air side of the sheet are imparted to the sheet by cross-machine direction dominant troughs in a transfer fabric.

4. The tissue sheet of claim 1 wherein the width of the cross-machine dominant linear protrusions is from about 0.3 to about 3 millimeters.

5. The tissue sheet of claim 1 wherein the width of the cross-machine dominant linear protrusions is from about 0.5 to about 1.5 millimeters.

6. The tissue sheet of claim 1 wherein the length of the cross-machine dominant linear protrusions is from about 3 to about 300 millimeters.

7. The tissue sheet of claim 1 wherein the length of the cross-machine dominant linear protrusions is from about 5 to about 50 millimeters.

8. The tissue sheet of claim 1 wherein the length of the cross-machine dominant linear protrusions is from about 5 to about 25 millimeters.

* * * * *